US005524854A

United States Patent [19]

McSwain et al.

[11] Patent Number: 5,524,854

[45] Date of Patent: Jun. 11, 1996

[54] STRUCTURAL SUPPORTING BRACKET

[75] Inventors: Gregory A. McSwain; Tadeusz Marko, both of St. Louis, Mo.

[73] Assignee: MKM Group Sales Corp., St. Louis, Mo.

[21] Appl. No.: 274,893

[22] Filed: Jul. 14, 1994

[51] Int. Cl.[6] ..... A47F 5/00

[52] U.S. Cl. ..... 248/354.1; 248/235

[58] Field of Search ..... 248/354.1, 235, 248/249, 241; 249/219.1; 52/127.2, 745.05, 745.06; 254/133 A; 403/389, 391; 264/33

[56] References Cited

U.S. PATENT DOCUMENTS

| | | | |
|---|---|---|---|
| 4,660,800 | 4/1987 | Horstketter | 249/24 |
| 4,846,433 | 7/1989 | Courtios et al. | 248/235 |
| 5,271,596 | 12/1993 | Holcomb et al. | 249/24 |

OTHER PUBLICATIONS

Williams Bridge Beam Hangers and Accessories pp. 49 & 52.

Richmond: Adjustable Fascia Overhang Bracket (Mar. 1927) pp. 8 & 9.

Richmond: Deep Adj. Fascia Overhang Bracket (Mar. 1931) pp. 10 & 11.

The Contractor's Engineer, Inc. Notes on Triad Hi–Q Overhang Brackets Dayton Superior Bridge Overhang Brackets p. 2.

*Primary Examiner*—Karen J. Chotkowski
*Assistant Examiner*—Gwendolyn Wrenn
*Attorney, Agent, or Firm*—Paul M. Denk

[57] ABSTRACT

A structural supporting system for the use as a temporary support in concrete overhang falsework construction and for the use as a support in concrete slab falsework truss construction and the like is disclosed. The structural supporting system includes a series of support beams and a plurality of support brackets positioned along the length of the support beam. A support bracket is provided at the opposite ends of the support beam for the suspended support of the support bracket as to increase or reduce the span of the support beams, as desired. Suspended support can be on one end of the support beam or on both ends of the support beam, as desired. A series of cooperating brackets can be positioned intermediate to the support brackets for the support of one support bracket in the concrete overhang falsework construction. A series of cooperating brackets can be positioned intermediate to the support brackets for the support of two support brackets in the concrete slab falsework truss construction. The support bracket or brackets include adjustable upper and lower opposing gripping surfaces for engaging corresponding upper and lower surfaces of the support beam, in adjustable mounting relationship thereto. The brackets include an integral attachment pin to secure the support beams to the support bracket for attachment of the support bracket to a fastener suspended from the concrete overhang form construction and the concrete slab falsework truss construction.

14 Claims, 5 Drawing Sheets

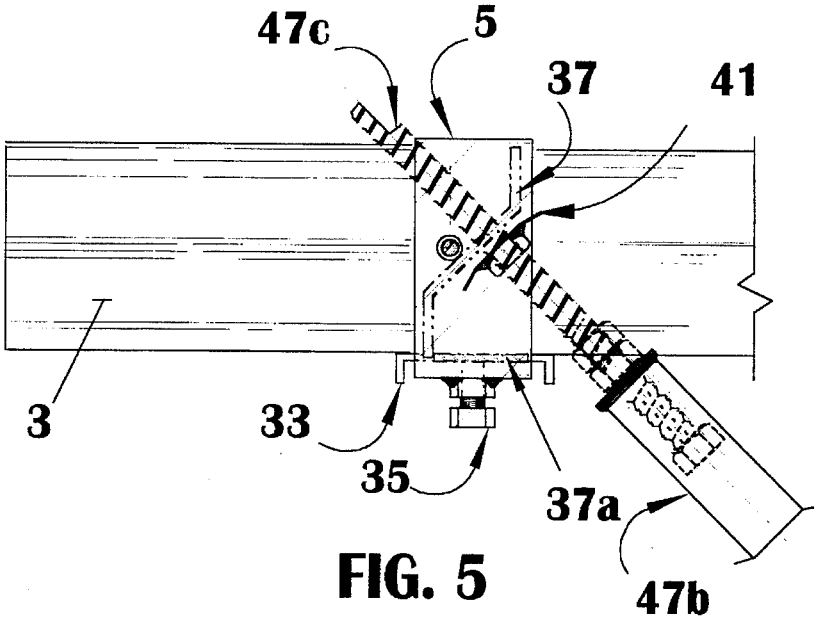
FIG. 5
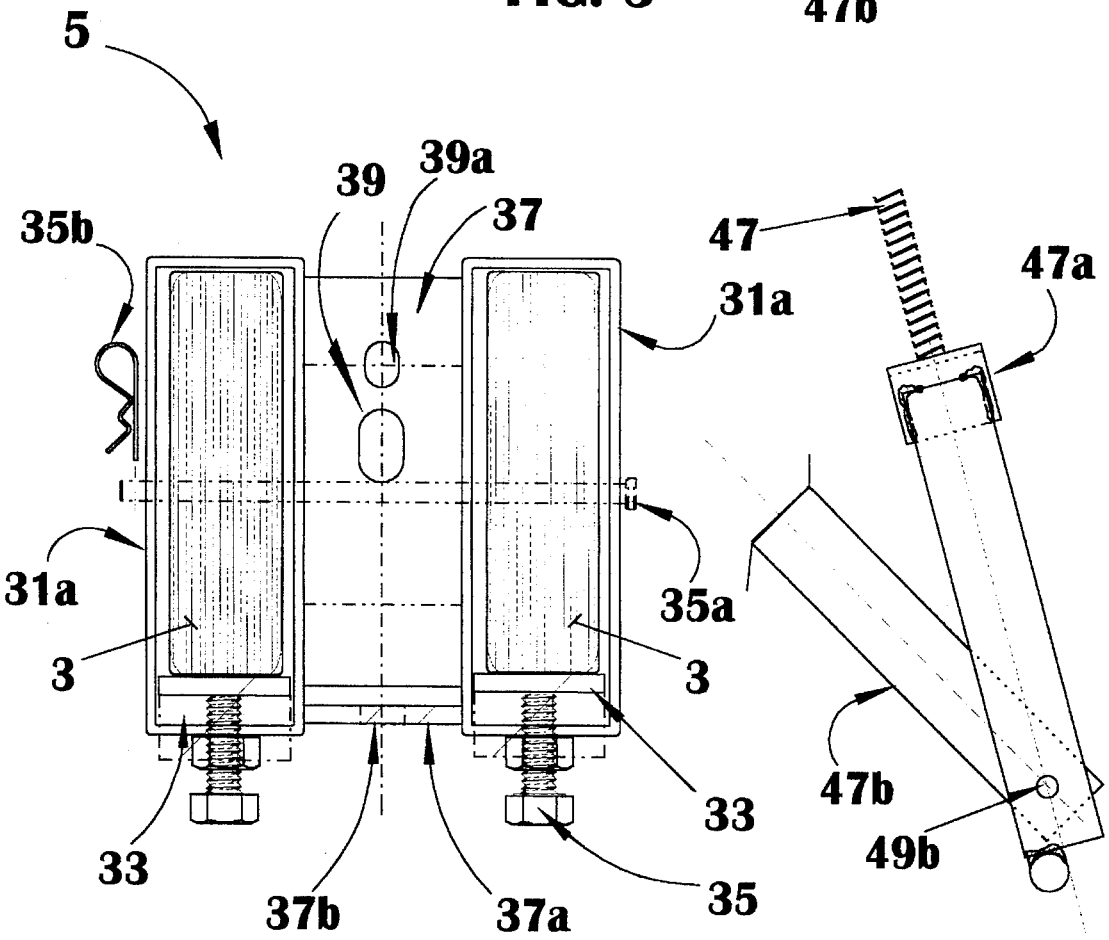
FIG. 6
FIG. 7

STRUCTURAL SUPPORTING BRACKET

BACKGROUND OF THE INVENTION

The present invention relates to a concrete form structural support system, and in particular, to an adjustable structural support system for use with concrete overhang and an adjustable truss system for the use as a temporary support, in, for example, concrete falsework forming, concrete slab construction and the like.

Various types of structural concrete overhang support systems are used to underlie concrete falsework forms in concrete bridge deck overhang, concrete slab construction, and the like. Most or such structural overhang support systems incorporate a fixed member welded assembly component that serves as a structural support component in the system. For example, one such system, made by Dayton Superior Corporation, or Miamisburg, Ohio, includes a triangular cantilever support bracket having a top horizontal, double-formed channel member. The double channel member is spaced apart at the channel webs by spacer tubes and bolts. The webs of the channel members have a series of holes that allow the interconnection or the channels. This allows a space between the channels which provides an attachment point for the support of the horizontal member with the use or a bolt holder. The location or the bolt holder is changed by moving the bolt holder along the series of holes in the horizontal member. The space between the channel also allows for the interconnection of vertical and diagonal support struts. The struts are composed or different diameter tubes to allow the telescoping of the inner and outer robe. The strut robes have a series or holes to interconnect the inner and outer member with a fastener to allow telescoping adjustment. The space between the channels also allows the use or an adjustable carrier at the end or the upper diagonal strut. The adjustment or the bolt carrier changes the location or the upper strut member. The change of location or the upper strut member allows a change in the level of the channel member. Despite the reduction in weight with the use or channel members, the length of the channel member is fixed and welded. The location of the upper strut adjuster is fixed and welded.

Another type of system, made by the Williams Form Engineering Corporation of Grand Rapids, Mich., includes a fixed and assembled triangular shaped bracket or support having a vertical and a horizontal leg. The triangular support has a hole in the vertical leg of the triangle that allows attachment of the triangle to a fixed support structure. The horizontal leg of the triangle has access holes consisting of adjustment fasteners have adjustment fasteners have supports at the ends to allow a beam to be placed within the supports. The level of the beam can be changed by the adjustment fasteners. Despite the simplicity of the fixed triangle, the support of the triangle and the adjustment of the triangle require separate systems.

Another type of support system, made by Contractor's Engineer, Inc. of Neodesha, Kans., includes a diagonal strut with an attachment point for the adjuster fastener. The strut allows support of one end of the horizontal beam with the use of a support bracket at the end of the support strut. The opposite end of the horizontal beam is supported with a fastener and plate at the support structure. Despite the adjustment of the horizontal beam by the strut support, the adjustment is at one end. The support strut is not a complete unit set and is supported from one support fastener.

While the aforementioned overhang systems have inherent advantages including adjustability, good load beating characteristics, and durability, there are some inherent drawbacks. First of all, the above mentioned structural supporting systems have fixed horizontal support lengths. Supports narrower than the fixed horizontal length of the support member require modification of the horizontal support member. Such prior art devices require additional support adjustment and attachment systems to complete the system. The prior art systems are limited to the function set forth. Additional support requirements, such as slab support between a pair of support girders, or slab support with spans between support girders that would require truss applications, would increase the overall cost of the support systems. The additional cost of such prior art devices is higher than it needs to be. Finally, such prior art devices have not provided the desired versatility and adjustability to be used as separate systems, and thereby have limited the productivity of construction workers in using such prior art systems.

SUMMARY OF THE INVENTION

One object of the present invention is the provision of a new and improved structural support system for use as a temporary support in concrete slab construction and the like, for example, concrete falsework forming in bridge deck construction.

Another object is the provision of such a structural support system which substantially reduces the amount of material and components required, as compared to prior art design, while increasing versatility, adjustability and productivity in the use of such systems.

Another object is the provision of such a structural support system which includes two identical brackets, used along a pair of support beams, both of which are fully adjustable along the length of the support beam as the support requirements change in the concrete slab construction, while permitting the adjustment of at least one of the brackets, and, preferably both of the brackets, along the length of the support beam to increase or decrease the span thereof.

Another object is the provision of such a structural support system having various bearing surfaces to allow the use of the brackets supported from a diagonal support element;

Another object is the provision of such a structural support system which has various supporting bearing surfaces to allow the use of the bracket means supported from a vertical support element.

Another object is the provision of such a structural support system which can be used on a variety of construction form settings.

Another object is the provision of such a structural support system having various supporting bearing surfaces to allow the use of a support element used at one beating point while being used in a truss application.

Another object is the provision of such a structural support system having various support bearing surfaces to allow the use of a support clement to be used at one bearing point while being used in an overhang support condition.

Another object is the provision of such a structural support system which is inexpensive and easy to manufacture; is simple and easy to install and use; provides versatility and flexibility in the use of the system in different construction environments; increases the productivity of construction workers in the use of such systems, is long wearing and durable in use; and is otherwise well adapted for the purposes intended.

Briefly stated, the structural support system of the present invention is constructed for the use as a temporary support in concrete falsework construction and the like. It includes dual, yet identical, brackets used along a pair of support beams. Both brackets are fully adjustable along the length of the support beam. The brackets can be adjusted as the support requirements change in the concrete slab construction by adjusting one, and preferably both, brackets along the length of the support beam to increase or decrease the support system span, as desired. The location and position of bearing surfaces will allow the brackets to be used as a support device in overhang concrete support or in truss applications.

The brackets include mounting means for mounting the brackets in concrete falsework construction. Specifically, the mounting means include support surfaces positioned between the support beams. The mounting means have a series of holes which allow suspension of the brackets from various fasteners suspended in the concrete falsework construction.

The support beams captured by the brackets are preferably formed from laminated veneer lumber or aluminum, or other equivalent structure, in order to provide a lightweight construction.

One of the brackets engages at least one free end of the support beams. This bracket end includes two vertically extended and laterally spaced apart elongate hollow bodies which slidably receive the beams. Each hollow body has an inner wall periphery, at least partially configured complimentary to one free end of the support beam, and integral mounting means extending between the hollow bodies for mounting the bracket, and thereby one or both the adjacent support beams, to the concrete form construction. Each of the hollow bodies is securable to one free end of the support beam. The mounting means include an integral support plate which extends horizontally and diagonally along the hollow bodies. The support plate has at least one, and preferably two, slotted holes to allow the engagement of support fasteners and system fasteners. The diagonal plate has holes for the use of a fastener for the support in the concrete support system. The integral mounting means preferably also include a second support plate extending from the first support plate running horizontally along the hollow bodies and connecting the laterally spaced hollow bodies. The horizontal plate has at least one hole for the use of a fastener for the support in the concrete support system.

Bearing or gripping plates are positioned horizontally along the support beam, within the hollow bodies, to facilitate gripping of the support beams. The gripping plates are formed with an angle extension of the plates running vertically to the support beams to limit movement after the support beams are installed, before the bearing plates are fully engaged against the lower edge of the support beam with the use of a threaded element.

The hollow bodies have holes in their vertical side walls to allow a round pin fastener to be installed after the support beams are installed. The round fastener is installed through at least one, and preferably both, of the support beams to secure the position of the brackets until the gripping means within the brackets is engaged. The round pin allows the brackets to rotate about the round pin. Rotation of the brackets with the gripping means installed will increase pressure against the gripping means and the upper surface of the hollow bodies. The increased pressure will limit the rotation of the bracket means along the support beams.

These and other advantages of the present invention will become more apparent from the ensuing description.

BRIEF DESCRIPTION OF THE DRAWINGS

FIG. 5 is a fragmented side elevation view of the bracket of FIG. 3 used in a concrete overhang falsework construction setting using an associated diagonal support fastener extending through a support plate to support the concrete falsework construction;

FIG. 6 is a fragmentary side elevation view of an associated diagonal support and associated adjustment means of FIG. 5 for support of the concrete falsework construction;

FIG. 7 is an end view elevation of the support bracket of FIG. 3 illustrating the associated support beams being contained between hollow bodies of the brackets with diagonally spaced and supported plates and gripping means being engaged with an attachment pin extending through the support beams and hollow bodies for support of the concrete falsework construction;

DESCRIPTION OF THE PREFERRED EMBODIMENT

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode carrying out the invention.

Figure 1:
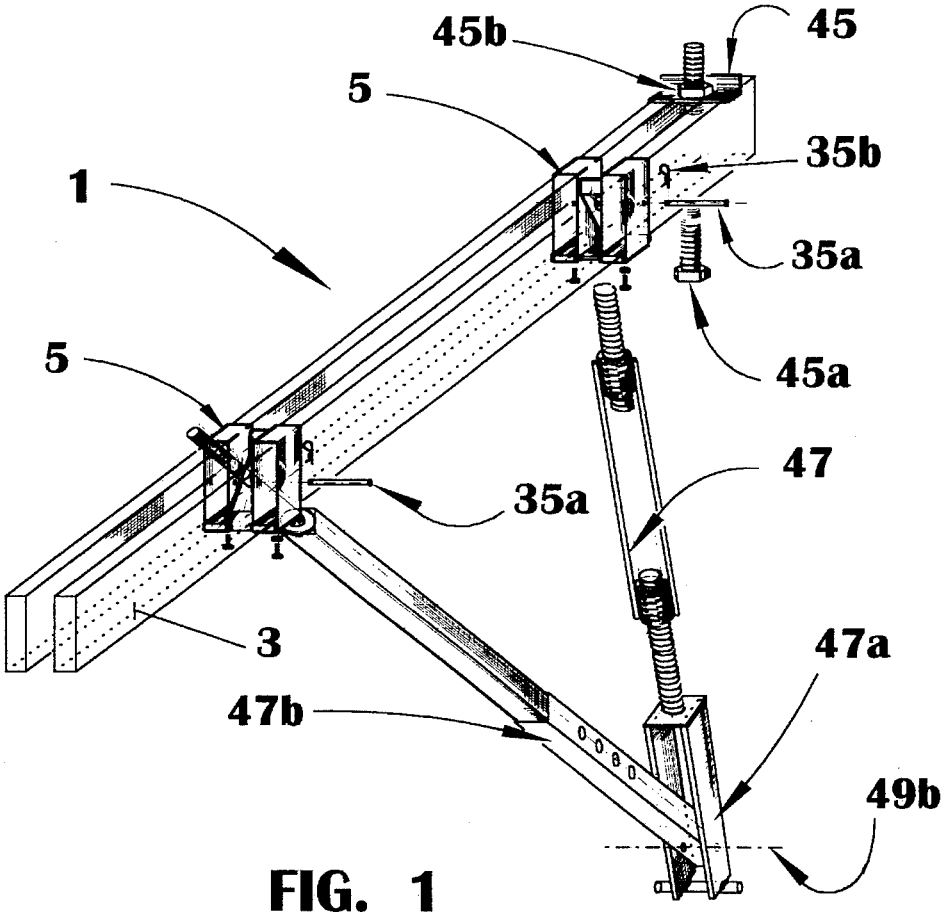
FIG. 1 is an isometric view of a structural support system of the present invention including support beams and associated brackets al opposite flee ends of the beams, together with a bracket positioned therebetween, as the present invention is assembled for use as overhang support in the falsework construction.
Figure 2:
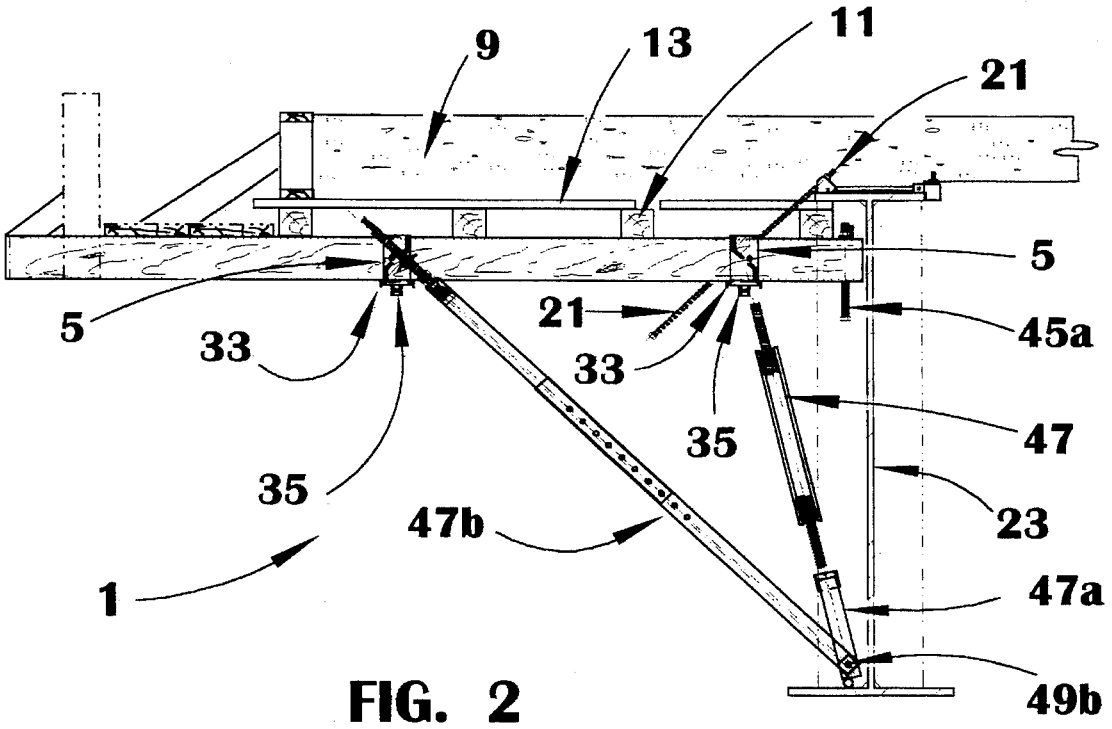
FIG. 2 is a fragmentary side elevation view illustrating the manner in which the structural support system of the present invention is used as a temporary support in concrete overhang falsework construction.

As best seen in FIGS. 1–2 of the drawings, a structural support system I of the present invention comprises an adjustable supporting bracket which is constructed for use as a temporary support in concrete falsework construction and the like, i.e., bridge deck forming where concrete falsework construction is required. When support system 1 is used in a concrete overhang construction environment, as shown in FIG. 2, the concrete overhang 9 is supported on a plywood or form sheet 13. Form sheet 13, in turn, rests on wooden blocks or spacers 11. Support system 1 supports spacers 11 to support the overhang, as will be described below.

In the concrete overhang support environment, the structural support system or adjustable support bracket 1 includes a pair of generally parallel, spaced apart supporting beams 3 which are received in a pair of spaced apart support brackets 5. The bracket 5 engages the two support beams 3 in spaced and supported relationship. A fastener 21 extends from one of the brackets 5 into the concrete overhang 9 to secure the bracket 5, and hence the support beams 3 and support system 1, to the concrete overhang falsework construction, as shown in FIG. 2.

Figure 3:
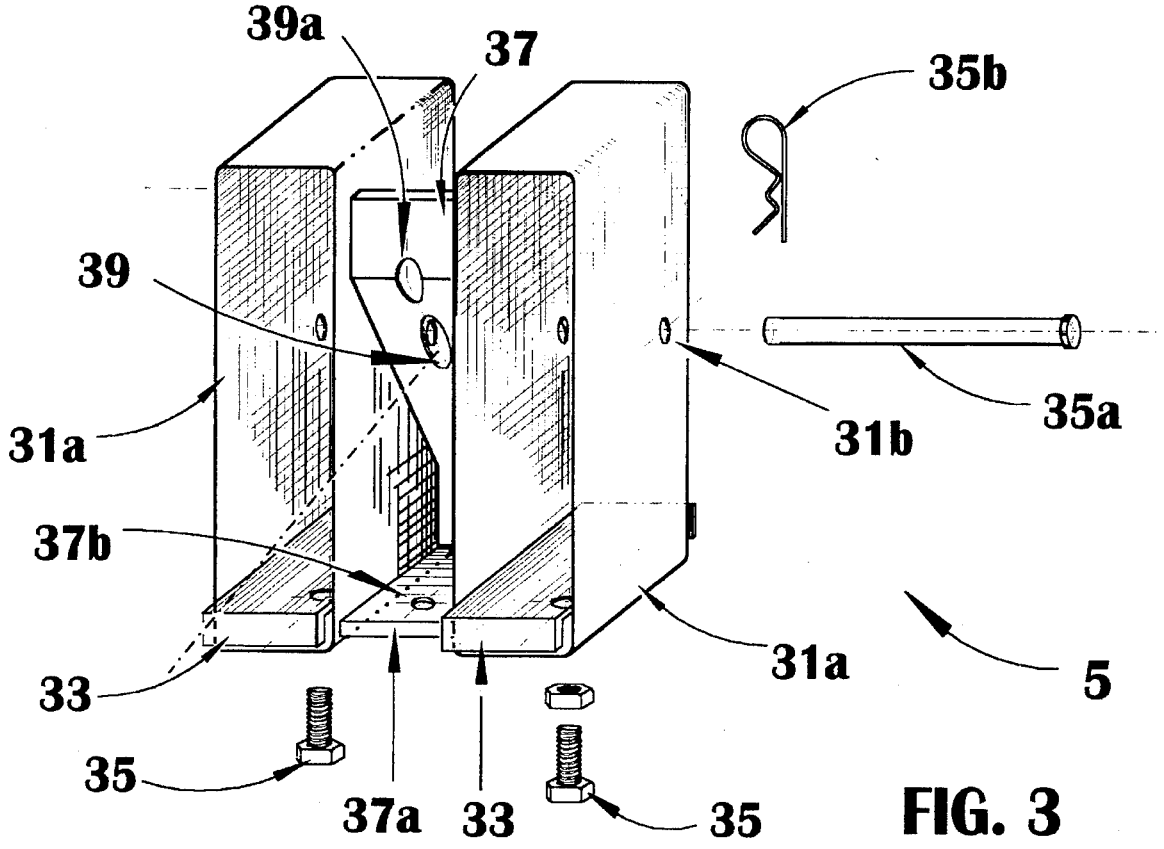
FIG. 3 is an isometric view of one type of support bracket used in the structural supporting system of the present invention.

Turning to FIG. 3, each bracket 5 includes two vertically extending and laterally spaced apart elongated hollow bodies 31*a*, defining axially extending openings. The bodies 31*a* are preferably substantially identical. In the overhang support system environment, of FIGS. 1–2, the openings of bodies 31*a* are sized and shaped to slidably receive the support beams 3, as illustrated in FIGS. 1–2 and 7. Preferably, the openings have a width slightly greater than the width of beam 3 and height somewhat greater than the height of beam 3.

A load plate 33 is placed at the bottom of each body 31*a* and the beams 3 sit on the respective load plate. The load plate 33 has a height slightly smaller than the difference between the height of the beam 3 and the body opening. Thus, when the load plate is placed in body 31*a*, the body opening is only slightly larger than the beam. The load plate 33 is vertically adjustable by way of a threaded bolt 35 which extends through a threaded opening in a bottom of body 31*a*. The bolt 35 and load plate provide a vertically adjustable gripping means for adjustably and fixedly the each hollow bodies 31*a* to the support beams 3. Simple threaded adjustment of each bolt 35 moves the load plate 33 into and out of the engagement with its associated support beam 3, thereby permitting attachment or removal of the support bracket 5 relative to the support beam 3, as will be appreciated. A nut is provided associated with the body 31*a* to secure the bolt in place, to ensure that the bolt, and hence the support system, will not loosen during use.

Bearing plates 37 and 37*a* are secured to the bodies 31*a* therebetween and hold the bodies in spaced apart relationship. Bearing plate 37 has upper and lower generally vertical sections which are joined together by a central diagonal section. The upper and lower sections are horizontally spaced apart so that one is near the back of the bodies and the other is near the front of the bodies. Plate 37 is generally vertically oriented between bodies 31*a*. Beating plate 37*a* is a generally planar plate positioned in a generally horizontal orientation between the bodies 31*a* near the bottoms thereof. Plate 37*a* has a bolt hole 37*b* formed therein. Bearing plate 37 has a bolt hole 39 formed in the diagonal section thereof and a bolt hole 39*a* formed at the junction of its vertical and diagonal sections.

An attachment pin 35*a* extends through one, and preferably both, of the bodies 31*a* and support beams 3 secure bodies 31*a* and beams 3 together. Pin 35*a* extends through holes 31*b* formed in the vertical side walls of the hollow bodies 31*a*. In order to secure attachment pin 35*a* engagement into support bracket 5, a simple hitch pin 35*b* is installed through a hole in attachment pin 35*a*. Other methods could of course be used to secure bracket 5 in place relative to beam 3. For example, pin 35 could have a threaded end which receives a nut, which would replace hitch pin 35*b*. Preferably a single attachment pin 35*a* is used to secure bracket 5 to beams 3 to allow for rotational or pivotal motion of support bracket 5 relative to beam 3. Load imposed on or against the bearing plates 37 and 37*a*, in the support overhang construction environment, will bear load on or against support bracket 5 when it is secured to the support beams 3. Rotation of beam 3 about attachment pin 35*a* creates a tight fit of the beam in the body 31*a*. The rotation of the beam will cause an edge of the load plate 33 and an edge of the top inner surface of the body 31*a* to grip or bite into the beam 3, to securely hold the beam in place. This creates a tighter, more secure, grip than would the use of only a friction grip when the beam 33 and body 31*a* are axially parallel.

Figure 4:
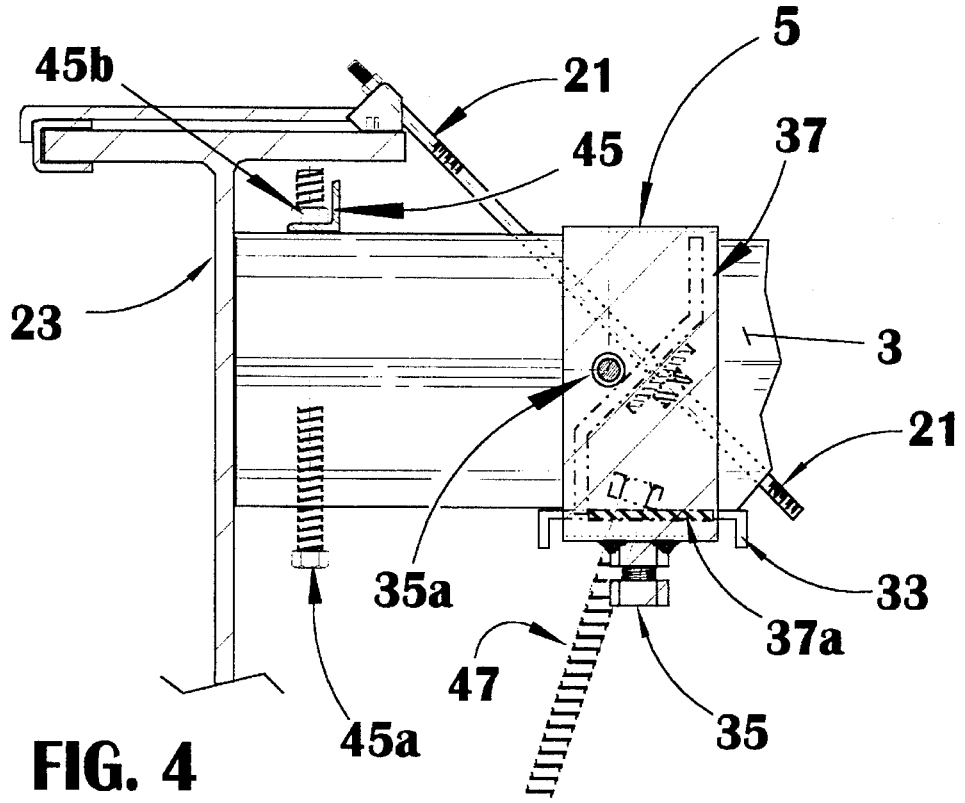
FIG. 4 is a fragmentary side elevation view, partly in cross-section, illustrating the manner in which the support bracket of FIG. 3 is suspended by an associated diagonal fastener in concrete overhang falsework construction.
Figure 8:
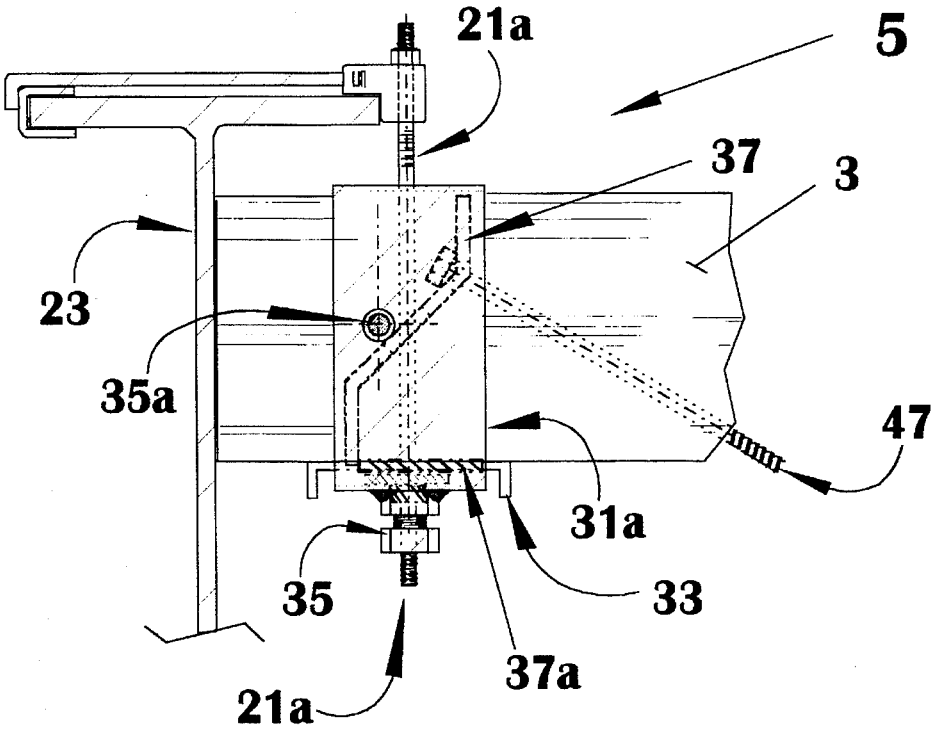
FIG. 8 is a fragmentary view in side elevation of the support bracket of FIG. 3 including an associated vertical support fastener through alignment in support plates together with associated fasteners for support of the concrete slab falsework truss construction.
Figure 9:
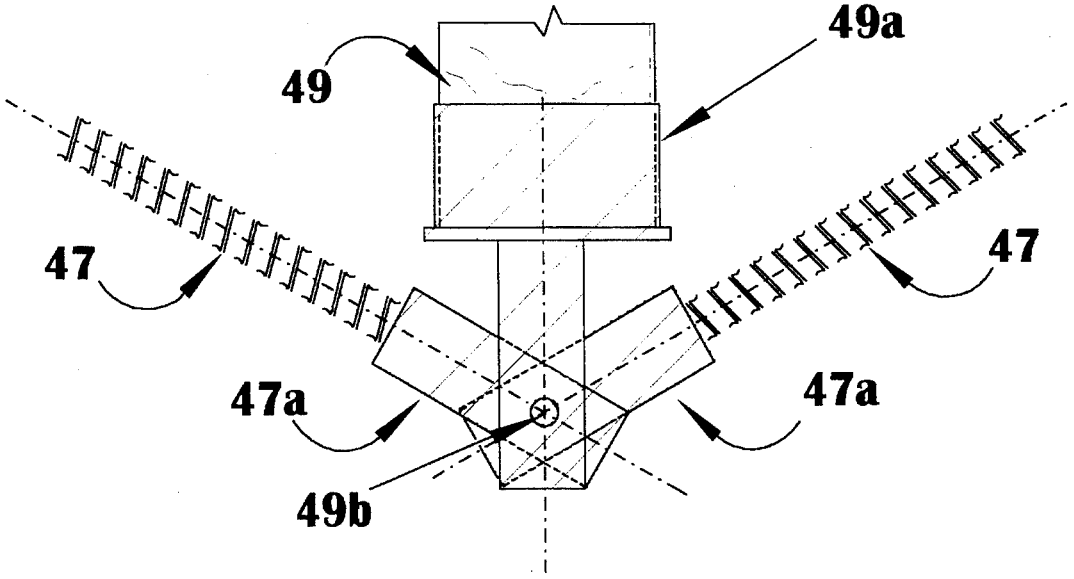
FIG. 9 is a fragmentary view in side elevation with associated bracket means of FIGS. 10–11 for the support of the concrete slab falsework truss construction.

In a concrete overhang falsework construction environment, as shown in FIG. 4, support system 1 is mounted to the overhang by a hanger unit 23 and a threaded fastener 21. One of the brackets 5 is preferably in close proximity to the hanger unit 23. Hanger unit 23 is preferably a vertically positioned I-beam having a vertical web and upper and lower cross bars. A screw receptacle (FIG. 2), preferably in the form of a block secured to the upper surface of the I-beam upper bar receives fastener 21. Fastener 21 extends through the diagonal section of bearing plate 37 of the bracket 5 located closest to hanger unit 23, through the screw receptacle, and into the concrete overhang, to facilitate securement of the support system to the overhang.

As shown in FIGS. 1–4, an adjustable fastener 47 is secured to bearing plate 37*a* of the bracket 5 adjacent the hanger unit 23. Fastener 47 allows for adjustment of the support bracket 1 in the concrete overhang support construction environment as shown in FIGS. 1–2 of the drawings. Fastener 47 is preferably a coil adjustable fastener having a threaded rod extending from opposing ends of an internally threaded tube. One end of the fastener 47 is threaded through hole 37*b* of support bracket load plate 37*a*. The opposite end of fastener 47 is secured to a support yoke 47*a*. An adjustable strut 47*b* is pivotably secured to yoke 47*a*, preferably at an end of the yoke remote from fastener 47, by a pin 49*b*. Strut 47*b*, in turn, is secured, at an end remote from yoke 47*a*, to the second support bracket 5 (i.e. the support bracket 5 remote from the hanger unit 23). The end or base of yoke 47*a* is situated on the bottom cross-bar of the hanger I-beam, near the intersection of the cross-bar and the vertical web. A pivot rod, which is secured to the bottom of yoke 47*a*, is positioned between the yoke and the cross-bar, and allows for pivotal movement of the yoke on the cross-bar relative to the hanger unit 23.

As seen in FIG. 4, a preliminary adjustment device 45 is provided to allow for preliminary adjustment of the support system 1. Adjustment device 45 is preferably a generally L-shaped or angle bracket which is placed on an upper surface of beam 3, and has an associated fastener or nut 45*b*. A coil bolt 45*a* extends intermediately through beam 3 through bracket 45 and nut 45*b* to provide another area for connection of support system 1 to the concrete overhang construction environment, as shown in FIGS. 1 and 2.

Adjustment of the coil bolt 45*a* into engagement with hanger unit 23 will cause support bracket I to rotate about support fastener 21 and for beam 3 to rotate about pin 35*a*. Beam 3 will then come into secure contact with bracket 5. This also will provide the beams 3 with a slope, to form an overhang having a sloping surfaces.

A threaded rod 47*c* extends from the end of strut 47*b* to connect strut 47*b* to bearing plate 37 of the second bracket 5. (FIGS. 5 and 6) Rod 47*c* is used to make final adjustments of the support system 1 in a concrete overhang support construction environment. The threaded fastener 47*c* extends through the support bearing plate 37. An adjuster plate 41 is positioned adjacent a bottom surface of the bearing plate 37. Rod 47*c* extends through plate 41 and, by means of a nut, bears against the beating plate 37 by the use of the adjuster plate 41. Rotation of the adjuster plate 41 is restricted between the hollow bodies 31*a* to prevent rotation of the adjustable plate 41 as the threaded fastener 47*c* is adjusted. Final adjustment of the strut 47*b* will ensure a tight and secure installation of the support bracket 1 at the support fastener 21 and against the load supporting element 23 as it is intended.

Figure 10:
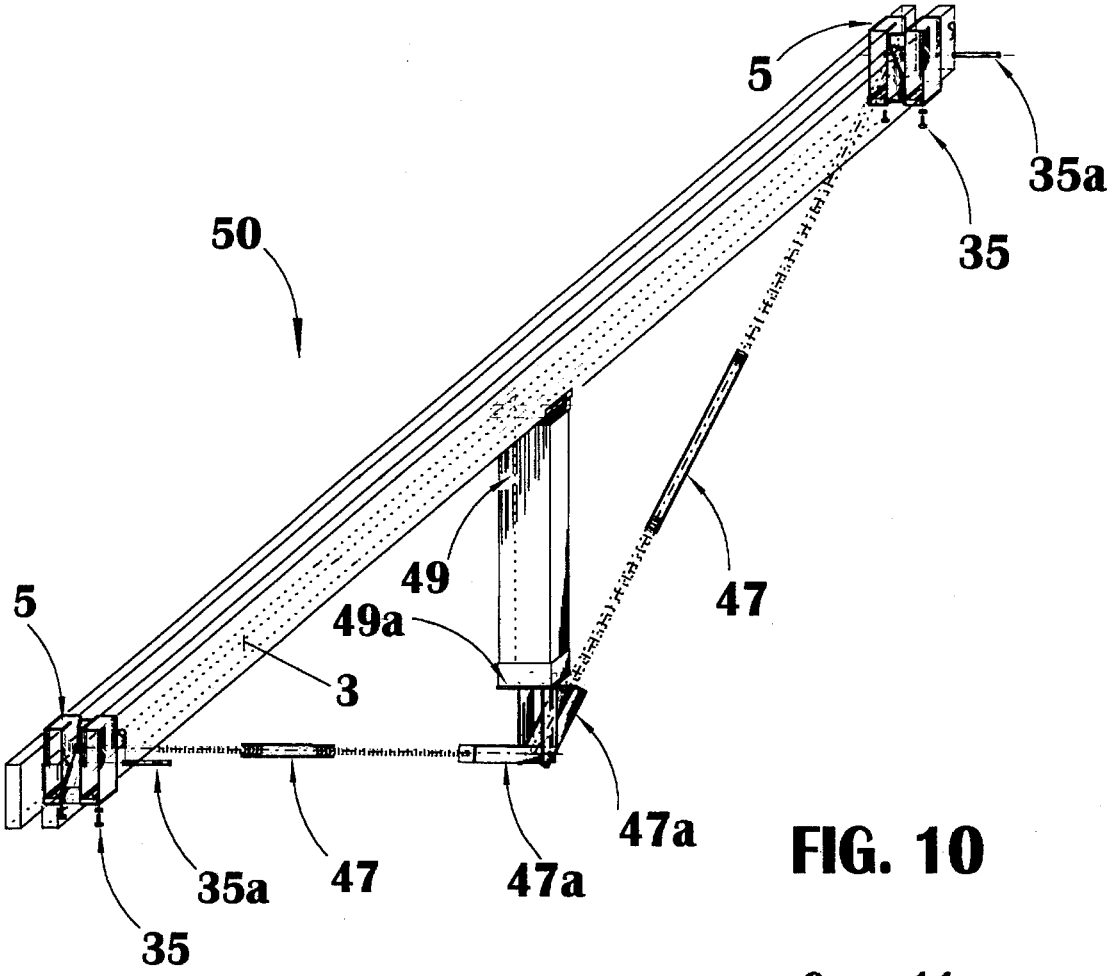
FIG. 10 is an isometric view of the structural support system of the invention including the support beams and the associated bracket means at opposite free ends thereof, together with associated bracket means positioned therebetween, as the present invention is assembled for use in the truss application in concrete support system in falsework construction.
Figure 11:
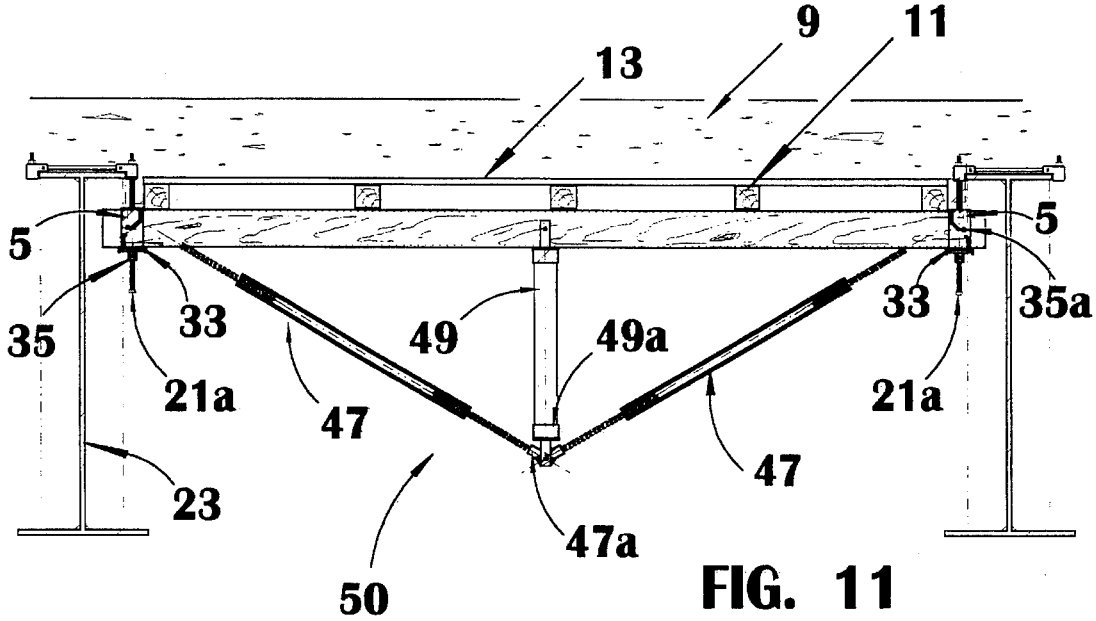
FIG. 11 is a fragmentary side elevation view of the bracket of FIG. 3 used in a different concrete truss falsework construction setting using an associated vertical fastener for support of the concrete falsework construction; Corresponding reference numbers will be used throughout the various figures of the drawings.

A second embodiment of the support system is shown in FIGS. 7–11 for use in a concrete slab falsework truss application environment. In FIGS. 10 and 11, the support system 1 is shown used in a horizontal adjustable truss concrete construction environment. The use of a truss in a slab support construction environment will generally require the relative location of the bearing point of support be specifically located to support the load and force from the resulting construction loads. The truss as herein described uses the support beams 3, with support brackets 5 being installed at opposite and opposing ends of the support beams. The variable locations of the support brackets 5 and intermediate bracket means will complete a variable truss support unit 50.

In this embodiment, fastener 21*a* extends vertically, rather than diagonally, from hanger unit 23 to bearing plate 37. Fastener 21 is thus able to extend vertically through both hole 39 in bearing plate 37 and bole 37*b* in bearing plate 37*a*, to support and mount the support bracket 5 in the concrete slab falsework truss application. Support plate 37 has an additional slotted hole 39*a* which receives the coil bolt adjustable fastener 47. Fastener 47, in turn, is attached to a yoke 47*a*. A fastener 47 extends from each bracket to yoke 47*a*, which is positioned horizontally intermediate, and vertically below, brackets 5. (FIGS. 10–11) Yoke 47*a*, in turn, is pivotably attached, by means of a simple threaded fastener 49*b*, to a lower strut support 49*a*. Lower strut support 49*a* is spaced below beams 3 by a vertical, mid-span support beam 49 which is secured to beams 3. As seen in FIGS. 10 and 11, two oppositely directed yokes 47*a* are used, each of which is connected to one of the brackets by an adjustable fastener 47.

It will be appreciated, as shown in FIG. 10, that the connection of the two support yokes 47*a* to strut base support 49*a* supports the mid-span support strut 49 to support the mid-span of support beams 3. It will be apparent that the attachment of the intermediate brackets and supports that the truss support 50 (FIGS. 10 and 11) can be adjusted through a full range of level or cambered conditions in the support beam 3, as needed in the shape of the slab support surface in a truss support construction environment.

We claim:

1. A structural supporting system for temporarily supporting concrete overhangs, or the like, the supporting system including:

at least two generally parallel spaced apart support beams positioned beneath said overhang;

a first and a second bracket slidably received on said support beams; said first bracket positioned at a beginning of said overhang and said second bracket being spaced from said first bracket; each said bracket having at least two spaced apart enclosed hollow bodies through which said support beams extend, a generally horizontal bearing plate and a generally diagonal bearing plate secured to and extending between said hollow bodies, and an adjusting plate received within each of said hollow bodies, each of said adjusting plates being movably operable within its hollow body to frictionally secure said beam within its hollow body in said hollow bodies;

a yoke;

a first adjustable extendable member extending between said first bracket and said yoke; and a second adjustable extendable member extending between said second bracket and said yoke, said second extendable member being pivotably secured to said yoke.

2. The support system of claim 1 including a pivot rod which extends through said first bracket, said pivot rod extending through said support beams to allow said support beams to pivot slightly in said hollow bodies.

3. The support system of claim 2 wherein said first bracket is secured to said support beams, said first bracket including a fastening rod which extends through one of said bearing plates into said cement overhang.

4. The support system of claim 3 wherein said fastening rod extends diagonally through said generally diagonal bearing plate into said cement.

5. The support system of claim 3 wherein said fastening rod extends vertically through said generally diagonal bearing plate into said cement.

6. The support system of claim 3 wherein said first extendible member comprises a coiled adjustable fastener which is secured at one end to said generally horizontal bearing plate of said first bracket and at another end to said yoke; said second extendible member comprising an adjustable strut which is secured at one end to said generally diagonal bearing plate of said second bracket and at another end to said yoke.

7. The support system of claim 6 wherein said concrete overlay has a first end, and said system including a hanger unit, said hanger unit comprising a generally vertical I-beam having a generally vertical web, an upper cross-bar, and a lower cross-bar, said upper cross bar being adjacent a bottom of said cement at said first end of said cement overhang; said first and second extendible members being sufficiently long to position said yoke on said I-beam upper cross-bar.

8. The support system of claim 7 wherein said first bracket is positioned to be horizontally forward of said yoke; said extendible members being adjusted to provide an upward force to support said overhang.

9. The support system of claim 7 including a preliminary adjuster for adjusting the slope of said support beams.

10. The support system of claim 9 wherein said adjuster includes a rod which extends generally vertically through at least one of said support beams below said hanger I-beam upper cross-bar, said rod being adjustable to be placed in contact with said upper cross-bar to create a force on said support beam to induce a slope in said support beam.

11. The support system of claim 3 wherein said yoke is positioned intermediate said bracket, said yoke spaced below said support beam by a generally vertical mid-span support beam, said extendible members being pivotally connected to said yoke.

12. The support system of claim 9 wherein each said extendible member comprises an adjustable coiled fastener.

13. A structural supporting system for temporarily supporting concrete, or the like, including a support bracket, a support beam, said support bracket accommodated on at least one free end of said support beam, said support bracket including two vertically extending and laterally spaced apart elongated enclosed hollow bodies, defining axially extending openings, each enclosed hollow body being complementary configured relative to the free end of the adjacent support beam, to be accommodated thereon, and said support bracket capable of being fixedly attached to said support beam when installed thereon, a bearing plate extending between and integrally attached with the inner surfaces of the hollow bodies of the support beam, said bearing plate having disposed sections, and select of said sections of the bearing plate having apertures therein for accommodating fastener means for attachment of the bracket to the structural supporting system during its installation.

14. The structural supporting system of claim 13 wherein said bearing plate having upper and lower generally vertically disposed sections, a diagonal section arranged there between, and a horizontal section extending integrally from the bottom of the lower vertical section of said bearing plate, select of said sections of the bearing plate having apertures therein for accommodating fastener means for attachment of the bracket to the structural supporting system during its installation.

* * * * *